US008047108B2

(12) United States Patent
Yahata

(10) Patent No.: US 8,047,108 B2
(45) Date of Patent: Nov. 1, 2011

(54) SHEET PROCESSING APPARATUS AND SHEET PROCESSING METHOD

(75) Inventor: Isao Yahata, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 874 days.

(21) Appl. No.: 11/533,938

(22) Filed: Sep. 21, 2006

(65) Prior Publication Data

US 2007/0062359 A1 Mar. 22, 2007

(30) Foreign Application Priority Data

Sep. 22, 2005 (JP) ..... 2005-276596

(51) Int. Cl.
*B65H 5/00* (2006.01)
*B65H 5/06* (2006.01)
*B26D 5/20* (2006.01)

(52) U.S. Cl. ..... 83/156; 83/76.8; 83/269; 83/371; 83/419; 271/188; 271/242

(58) Field of Classification Search ..... 83/360–372, 83/202, 211–212, 80, 76.8, 35–36, 63, 74, 83/72, 176, 156, 418, 419, 268, 269; 234/74; 271/227, 182, 188, 209, 242, 243, 244, 245, 271/230; 270/58.07, 58.01
See application file for complete search history.

(56) References Cited

U.S. PATENT DOCUMENTS 5,509,645 A * 4/1996 Shinno et al. ..... 270/58.17
5,586,479 A * 12/1996 Roy et al. ..... 83/74
5,681,036 A * 10/1997 Wakahara et al. ..... 271/10.12
6,361,036 B1 * 3/2002 Nakazawa ..... 270/58.07
6,907,806 B1 * 6/2005 Okamoto et al. ..... 83/76.8
7,520,498 B2 * 4/2009 Hattori et al. ..... 270/58.07
7,546,081 B2 * 6/2009 Tokita et al. ..... 399/407
2001/0049990 A1 * 12/2001 Takaishi et al. ..... 83/628
2006/0261544 A1 * 11/2006 Tamura et al. ..... 271/303

FOREIGN PATENT DOCUMENTS

JP 2002-193493 7/2002
JP 2002-274699 9/2002
JP 2004-331299 * 11/2004

* cited by examiner

*Primary Examiner* — Laura M. Lee
(74) *Attorney, Agent, or Firm* — Turocy & Watson, LLP

(57) ABSTRACT

A sheet processing apparatus comprises a first conveyer roller pair arranged at the upstream side of a sheet conveyance route and a second conveyer roller pair arranged at the downstream side of the sheet conveyance route so as to convey a sheet of paper from the upstream side to the downstream side. Additionally, a punching unit is arranged between the first conveyer roller pair and the second conveyer roller pair. The second conveyer roller pair is made to operate as a slipping roller after the time when the leading end of the sheet of paper being conveyed passes the first conveyer roller pair and a stopper is made to appear at a position downstream relative to the second conveyer roller pair so as to make the leading end of the sheet of paper abut the stopper in order correct the skew, if any, of the sheet of paper.

11 Claims, 7 Drawing Sheets

SHEET PROCESSING APPARATUS AND SHEET PROCESSING METHOD

CROSS REFERENCE TO RELATED APPLICATION

This application is based upon and claims the benefit of priority from the prior Japanese Patent Application No. 2005-276596, filed on Sep. 22, 2005, the entire contents of which are incorporated herein by reference.

BACKGROUND OF THE INVENTION

1. Field of the Invention

The present invention relates to a sheet processing apparatus for correcting skews and performing punching processes on the sheets delivered from an image forming apparatus such as an MFP (multi function peripherals), which is a composite digital machine, a copying machine or a printer.

2. Description of the Related Art

Image forming apparatus such as MFPs, copying machines and printers are provided at a sheet delivery section of the image forming apparatus main body with a post-processing unit for performing post-processing operations including an operation of sorting sheets where an image is formed, that of stapling sheets and/or that of punching sheets.

In such a post-processing unit, the sheet of paper delivered from the image forming apparatus can move aslant and become skewed relative to the sheet delivering direction. When the skewed sheet of paper is subjected to a punching process (and punched), one or more than one holes can be produced at wrong positions by the punching process to give rise to a problem for a succeeding filing operation. For this reason, the post-processing unit is equipped with a skew correcting means for correcting the skew (if any) of the sheet of paper before the punching process.

Jpn. Pat. Appln. Laid-Open Publication No. 2002-274699 describes a sheet processing apparatus that can correct skews. The apparatus described in the above-cited Patent Document comprises a punch unit for performing a punching process on the sheet of paper being delivered to it and the sheet of paper is made to abut a nipper of an inlet roller arranged upstream of the punch unit in order to correct the skew, if any, of the sheet of paper. However, with the apparatus described in the above-cited Patent Document, the sheet of paper that has been corrected for the skew is forced to travel a long distance before it gets to the punch unit. Therefore, the sheet of paper can be skewed again during the travel over that distance.

Jpn. Pat. Appln. Laid-Open Publication No. 2002-193493 described a punching processing apparatus that can correct the skew, if any, of a sheet of paper. In the punching processing apparatus described in the above-cited Patent Document, a registration member (registration roller) is arranged downstream relative to the punching means of the apparatus and the front end of the sheet of paper being delivered from an image forming apparatus main body is made to abut the registration member by the sheet conveying force of the sheet delivery roller of the image forming apparatus main body in order to correct the skew, if any.

However, since punching processing apparatus described in the above-cited Patent Document utilizes the sheet conveying force of the sheet delivery roller of the image forming apparatus main body, a certain degree of positional accuracy is required for aligning the image forming apparatus main body and the post processing apparatus to by turn poses limitations to the mechanical configuration of the post processing apparatus.

In view of the above-identified circumstances, it is therefore an object of the present invention to provide a sheet processing apparatus having a simple configuration that can correct the skew, if any, of a sheet of paper and accurately execute a punching process.

DETAILED DESCRIPTION OF THE INVENTION

Throughout this description, the embodiments and examples shown should be considered as exemplars, rather than limitations on the apparatus of the present invention.

Now, preferred embodiments of the present invention will be described by referring to the accompanying drawings. Throughout the drawings, the same or similar components are denoted respectively by the same reference symbols.

Figure 1:
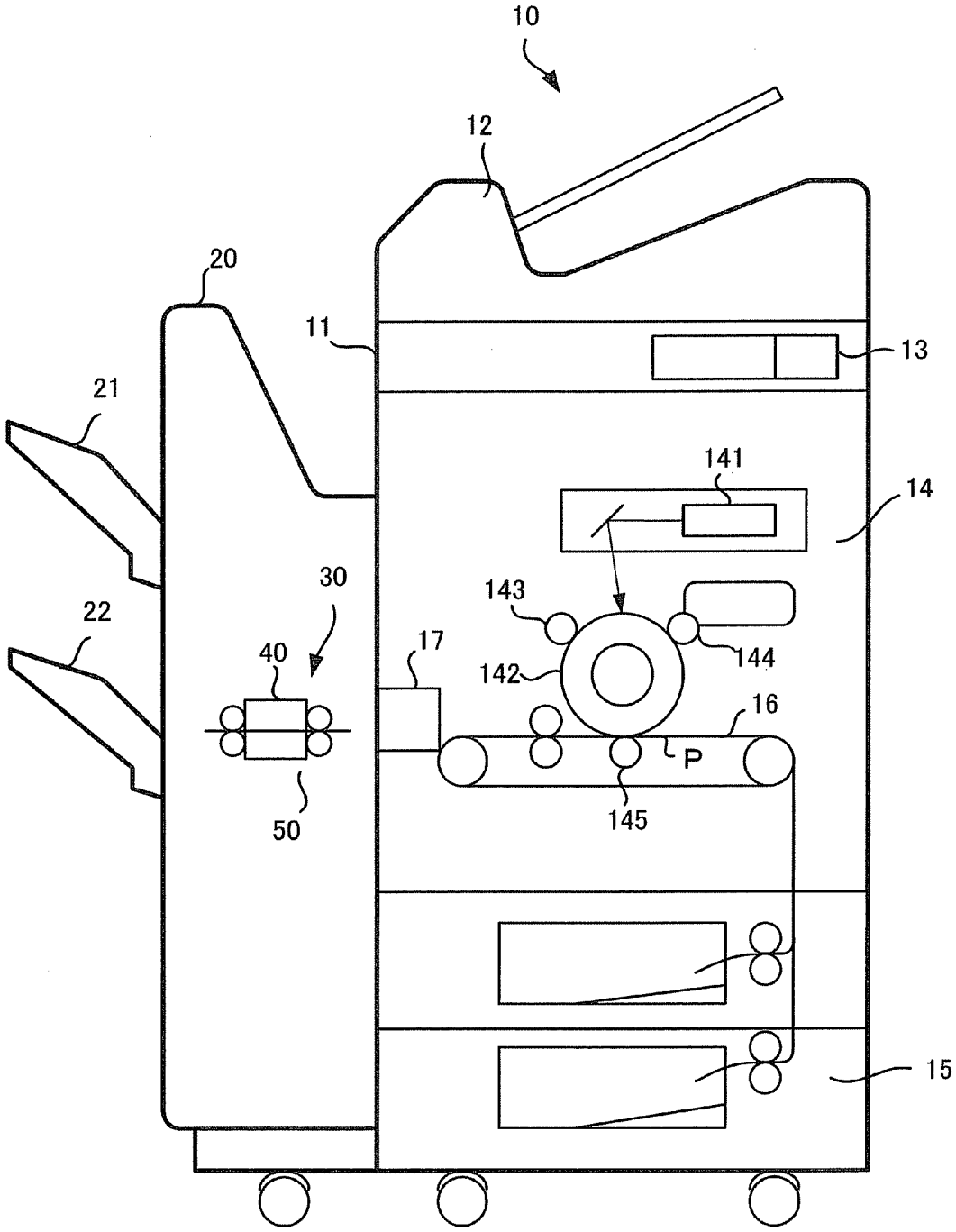
FIG. 1 is a schematic illustration of an image forming apparatus equipped with a sheet processing apparatus according to the present invention, showing the overall configuration thereof.
Figure 2:
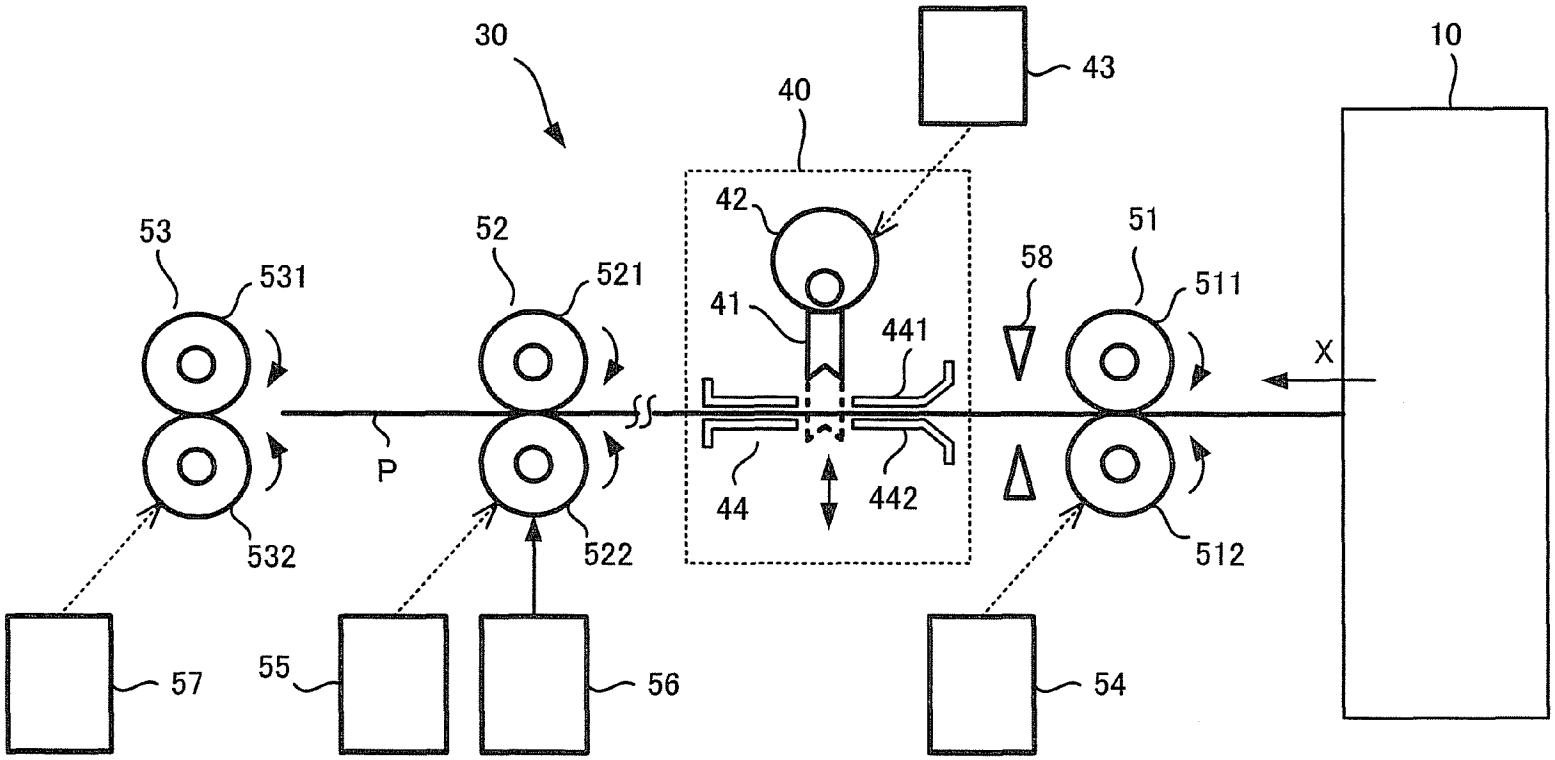
FIG. 2 is a schematic illustration of an embodiment of sheet processing apparatus according to the present invention, showing the configuration thereof.

FIG. 1 is a schematic illustration of an image forming apparatus equipped with a sheet processing apparatus according to the present invention, showing the overall configuration thereof. FIG. 2 is a schematic illustration of a principal part of an embodiment of sheet processing apparatus according to the present invention, showing the configuration thereof.

FIG. 1 shows an MFP (multi function peripheral) that operates as an image forming apparatus. The image forming apparatus 10 comprises a scanner section 11, an automatic document feeder (ADF) 12 and an operation section 13 in an upper part thereof. A printer section 14 and a sheet feeding section 15 are arranged respectively in a central part and in a lower part of the image forming apparatus 10. A finisher 20 is arranged contiguously relative to the image forming apparatus 10 for punching operations and stapling operations.

The printer section 14 typically has a tandem type color laser printer. The printer section 14 includes a laser 141 and a photosensitive drum 142. A charging device 143, a developing device 144 and a transferring device 145 are arranged around the photosensitive drum 142. Toner is supplied to the developing device 144 from a toner cartridge.

Now, the operation of the printer section 14 will be described below. The surface of the photosensitive drum 142 is scanned for exposure by the laser beam from the laser 141 to form an electrostatic latent image on the photosensitive drum 142. The electrostatic latent image is developed by the developing device 144 to form a toner image on the photosensitive drum 142. The toner image is then transferred onto a sheet of paper P by the transferring device 145. For a color printing process, toner cartridges of four colors including cyan, magenta, yellow and black are arranged in a row and photosensitive drums and optical units of the respective colors are provided.

The sheet feeding section 15 has a plurality of sheet feeding cassettes for containing sheets of paper of various different sizes. A sheet of paper P is sent from one of the sheet feeding cassettes to conveyor belt 16 and an image is formed on the sheet of paper P. The sheet of paper P on which an image is formed is then delivered to the outside by way of the sheet delivery section 17 and conveyed to the finisher 20.

The finisher 20 performs post-processing operations such as stapling and punching on the sheet of paper P and delivers it to either a sheet delivery tray 21 or a sheet delivery tray 22. The sheet delivery trays 21, 22 are driven to move up and down by a sheet delivery tray drive section so that the sheet of paper P is delivered to either of the trays.

The finisher 20 is provided with a sheet processing apparatus 30 according to the present invention. The sheet processing apparatus 30 comprises a punching unit 40 for punching the sheet of paper P conveyed from the image forming apparatus 10 and a skew correcting section 50 for correcting the skew of the sheet of paper P before punching the sheet.

FIG. 2 schematically illustrates the specific configuration of the sheet processing apparatus 30. Referring to FIG. 2, reference symbol 40 denotes the punching unit. The punching unit 40 includes a hole cutting blade 41, an eccentric cam 42 for driving the hole cutting blade 41 to move up and down, a punch motor 43 for driving the eccentric cam 42 to rotate and a punch die 44. The punch die 44 includes an upper die 441 and a lower die 442 and the sheet of paper P is conveyed between the upper die 441 and the lower die 442. The sheet of paper P is punched as the hole cutting blade 41 is reciprocated in the direction of the punch die 44 (that is orthogonal relative to the direction of conveying the sheet of paper P).

On the other hand, a first conveyer roller pair 51 and a second conveyer roller pair 52 are arranged respectively at the sheet feeding side and at the sheet discharging side of the punching unit 40 to convey the sheet of paper P from the upstream side to the downstream side. Since the sheet of paper P flows from the printer section 14 toward the tray 21 or the tray 22, the side of the printer section 14 is referred to as upstream side and the side of the tray 21 or the tray 22 is referred to as downstream side in the following description.

Additionally, a third conveyer roller pair 53 is arranged further downstream relative to the second conveyer roller pair 52. The conveyer roller pairs 51, 52 and 53 are driven to rotate respectively by conveyor motors 54, 55 and 57.

The first conveyer roller pair 51 includes upper and lower conveyer rollers 511, 512, which are driven to rotate by the conveyer motor 54 to convey a sheet of paper P, pinching it between them.

The second conveyer roller pair 52 also includes upper and lower conveyer rollers 521, 522, which are driven to rotate by the conveyer motor 55 to convey a sheet of paper P, pinching it between them. The second conveyer roller pair 52 can change the condition of contact of the rollers 521, 522 by means of a load controller 56. More specifically, the second conveyer roller pair 52 has a functional feature of registration roller where the rollers 521, 522 are brought into tight contact with each other and a functional feature of slipping roller where the rollers 521, 522 are brought into loose contact with each other. At the time of the operations of conveying a sheet of paper P, and correcting the skew (as will be described in greater detail hereinafter), the second conveyer roller pair 52 operates as a registration roller and a slipping roller, respectively.

Similarly, the third conveyer roller pair 53 includes upper and lower conveyer rollers 531, 532, which are driven to rotate by the conveyer motor 57.

A sensor 58 is arranged between the sheet feeding side of the punching unit 40 and the first conveyer roller pair 51 to detect the condition of being conveyed of the sheet of paper P. In this embodiment of the invention, the sheet of paper P is turned upside down (with the image carrying surface facing downward) when it is conveyed in the direction of arrow X. Any of a variety of mechanisms for turning the sheet of paper P upside down may be used for the purpose of the present invention.

Figure 3:
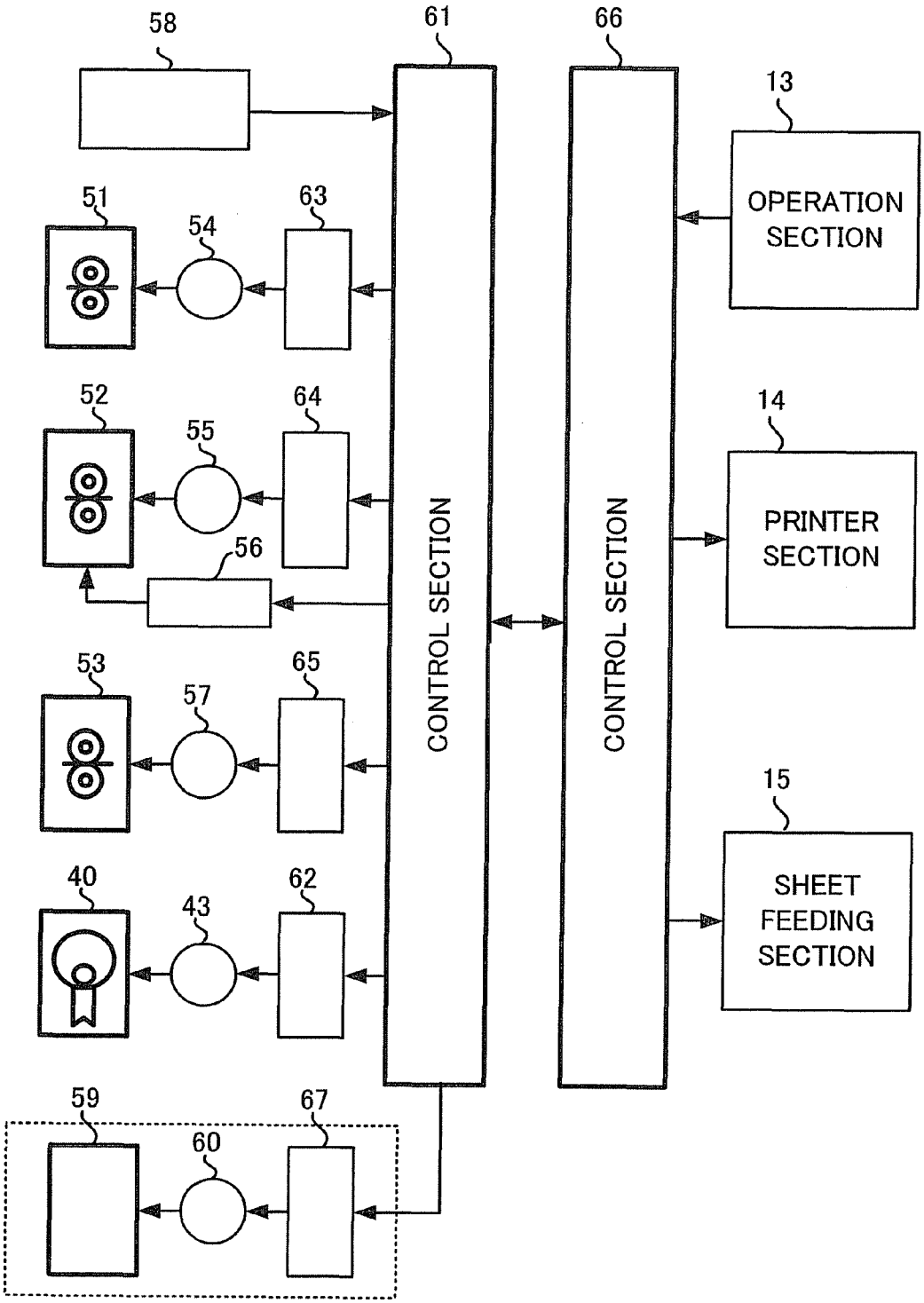
FIG. 3 is a schematic block diagram of the control system of a sheet processing apparatus according to the present invention.

FIG. 3 is a schematic block diagram of the control system of a sheet processing apparatus 30 according to the present invention and an image forming apparatus 10 to be used with the apparatus 30. Referring to FIG. 3, reference symbol 61 denotes a control section, which is a microprocessor that includes a CPU. In FIG. 3, reference symbol 62 denotes a motor drive circuit for driving the punching motor 43 and reference symbol 63 denotes a motor drive circuit for driving the conveyer motor 54, whereas reference symbol 64 denotes a motor drive circuit for driving the conveyer motor 55 and reference symbol 65 denotes a motor drive circuit for driving the conveyer motor 57. The control section 61 controls the load controller 56 and the outcome of the detecting operation of the sensor 58 is input to it.

In FIG. 3, reference symbol 66 denotes a control section for controlling the image forming apparatus 10, which is a microprocessor that includes a CPU. The control section 61 and the control section 66 exchange information with each other to coordinate the image forming operation of the image forming apparatus 10 and the operation of the finisher 20. Various directives are input by the user to the control section 66 by way of the operation section 13 and the control section 66 controls the operation of the printer section 14 and that of the sheet feeding section 15 according to the directives so as to convey the sheet of paper P on which an image is formed to the finisher 20.

When the size of sheet of paper is selected by the user by way of the operation section 13, the control section 66 controls the image forming operation so as to shift the position of the third conveyer roller pair 53 according to the information on the selected size. Alternatively, a size sensor for detecting the size of the sheet of paper to be used for an image forming operation may be provided and the position of the third conveyer roller pair 53 may be shifted according to the information on the detected size of sheet of paper.

Now, the operation of the sheet processing apparatus 30 according to the present invention will be described by referring to FIGS. 4A through 4E. The sheet of paper P on which an image is formed by the printer section 14 of the image forming apparatus 10 is then conveyed to the sheet processing apparatus 30.

Figure 4A:
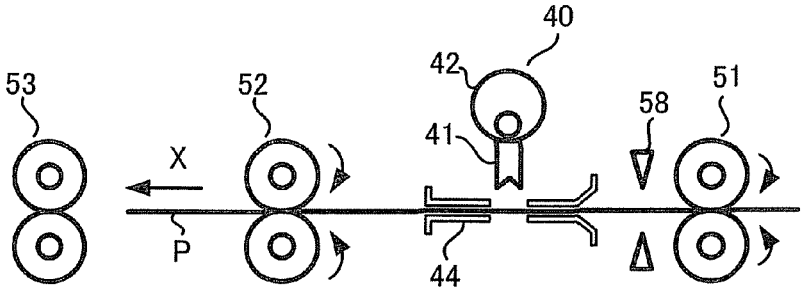
FIGS. 4A through 4E are schematic illustrations of the operation of a sheet processing apparatus according to the present invention.

FIG. 4A illustrates a condition where the sheet of paper P on which an image is formed by the printer section 14 is being conveyed toward the punching unit 40. In the initial stages, the first, second and third conveyer roller pairs 51, 52, 53 are driven to rotate in the same sense respectively by the conveyer motors 54, 55, 57 so that the sheet of paper P is conveyed in the first direction (the direction of arrow X) from the upstream to the downstream. At this time, the second conveyer roller pair 52 operates as a registration roller. The hole cutting blade 41 of the punching unit 40 is located at a high position separated from the punching die 44.

Figure 4B:
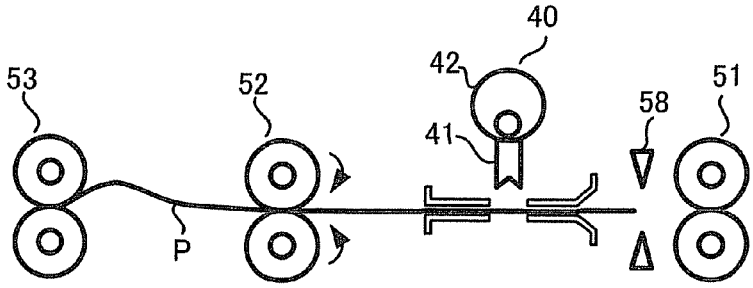

As a sheet of paper P is brought in and the sensor 58 detects that the leading end of the sheet of paper P passes the first conveyer roller pair 51, the motor 57 stops to by turn stop the third conveyer roller pair 53. As shown in FIG. 4B, the sheet of paper P is conveyed by the first and second conveyer roller pairs 51, 52 and, as the sensor 58 detects that the tail end section of the sheet of paper P passes the first conveyer roller pair 51, the rollers 521, 522 of the second conveyer roller pair 52 are made to lightly contact each other under the control of the load controller 56. In other words, the second conveyer roller pair 52 operates as a slipping roller. As a result, the second conveyer roller pair 52 conveys the sheet of paper P downstream with force weaker than before and makes the leading end of the sheet of paper P abut the third conveyer roller pair 53.

More specifically, the third conveyer roller pair 53 is located downstream relative to the second conveyer roller pair 52 and operates as a stopper that appears at a position good for blocking the forwardly moving sheet of paper P that is being conveyed after passing the second conveyer roller pair 52. On the other hand, the second conveyer roller pair 52 operates as a slipping roller, while the rollers of the second roller pair 52 are being made to lightly touch each other. Thus, if the sheet of paper P is skewed, the skew is corrected as the sheet of paper P is forced to abut the third conveyer roller pair 53 while it is slightly bent.

Figure 4C:
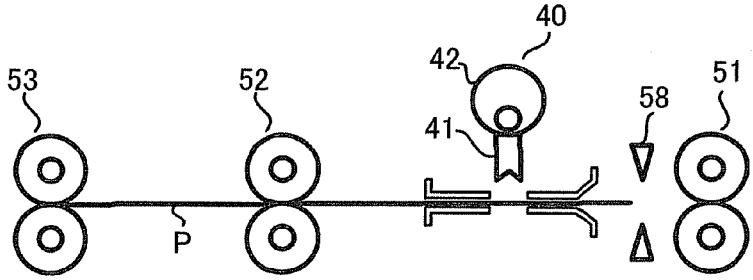

FIG. 4C illustrates the sheet of paper P whose skew has been corrected.

Figure 4D:
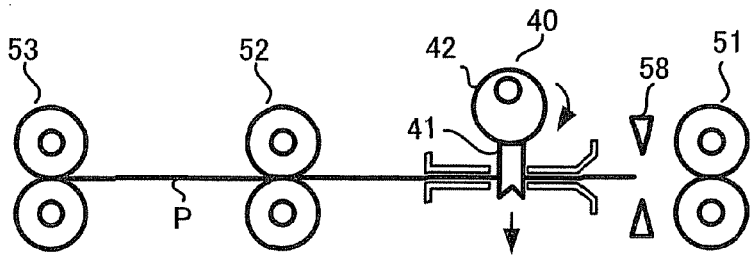
Figure 4E:
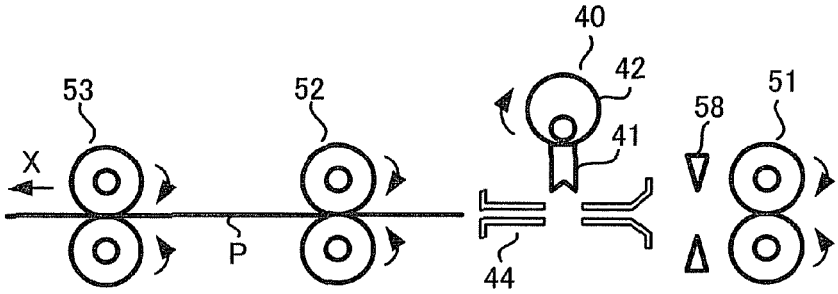

Then, the eccentric cam 42 of the punching unit 40 is driven to rotate by the punching motor 43 and the hole cutting blade 41 is forced to move downward as shown in FIG. 4D. As a result, the sheet of paper P is subjected to a punching process. Since the skew, if any, of the sheet of paper P has been corrected at the time of the punching process, the sheet of paper P is punched at a right position.

After the punching process, the second conveyer roller pair 52 is controlled by the load controller 56 so as to operate as a registration roller. Then, conveyer motors 54, 55, 57 are driven to rotate and the sheet of paper P is conveyed in the direction indicted by the arrow X in FIG. 4E so that the conveyer motors 54, 55, 57 become ready for receiving another sheet of paper P. Thereafter, the steps of operation of FIGS. 4A through 4E are repeated so that sheets of paper P are sequentially subjected to a punching process and then delivered to the delivery tray 21 or 22.

Thus, the sensor 58 detects the time when the sheet of paper P is fed in and the leading end thereof passes the first conveyer roller pair 51 and time when the tail end of the sheet of paper P passes the first conveyer roller pair 51 and notifies the control section 61 thereof. The control section 61 controls the motor drive circuits 63, 64, 65 and the load controller 56 by referring to the outcome of detection of the sensor 58. Note that the upstream first conveyer roller pair 51 is made to stop its operation during the skew correcting operation (between FIG. 4B and FIG. 4D).

Figure 5:
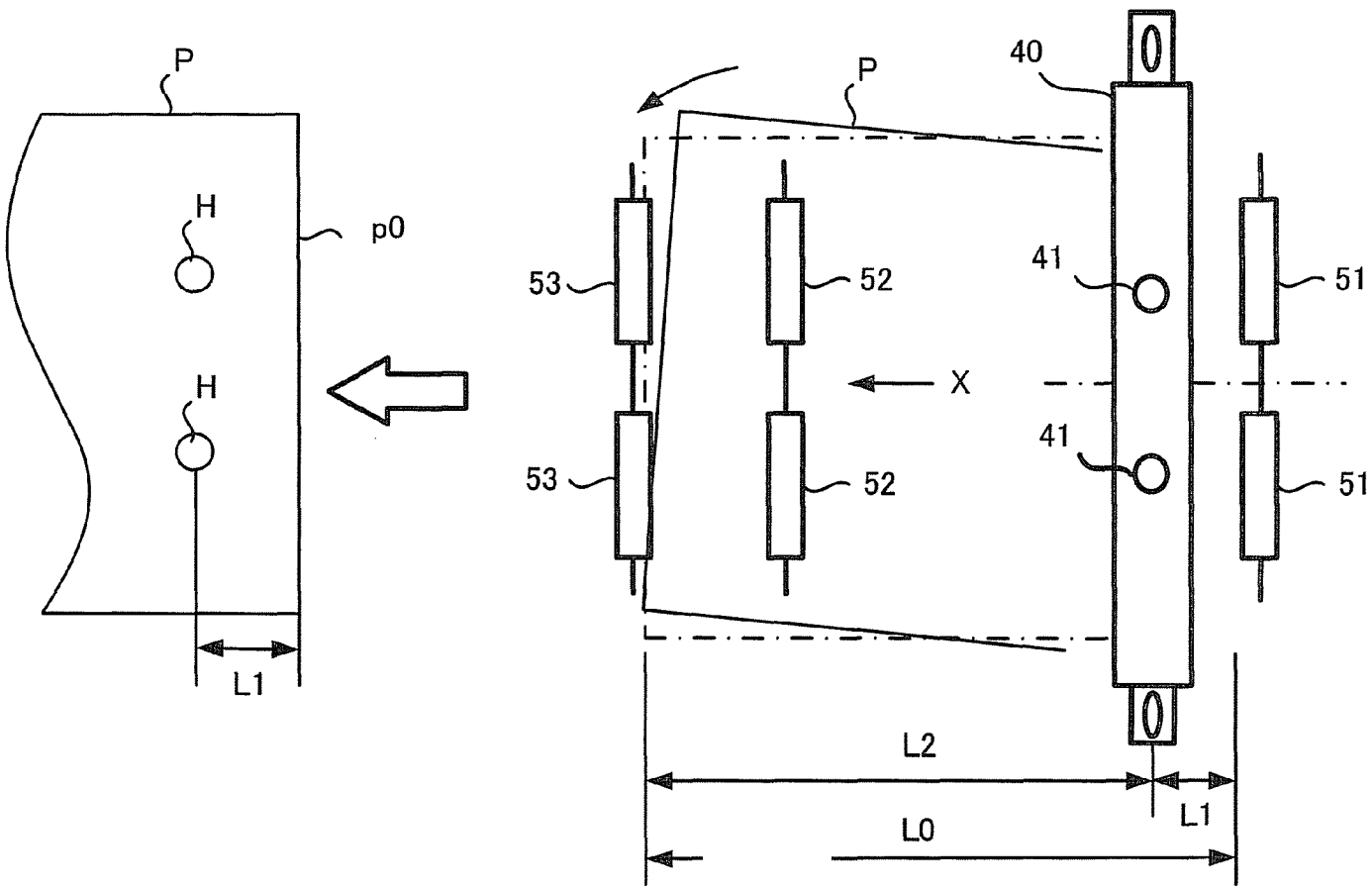
FIG. 5 is a schematic illustration of the skew correcting operation of a sheet processing apparatus according to the present invention.

FIG. 5 is a schematic illustration of the skew correcting operation and the punching process of the sheet processing apparatus. FIG. 5 illustrates a state where the sheet of paper P passes the second conveyer roller pair 52 and abuts the third conveyer roller pair 53. If the sheet of paper P is skewed as indicated by solid lines in FIG. 5, it is corrected for the skew as indicated by dotted chain lines because it is continuously and lightly pushed against the third conveyer roller pair 53 by the rotating motion of the second conveyer roller pair 52. The sheet of paper P is punched by the punching unit 40 after the skew, if any, is corrected so that a hole H is cut in the sheet of paper P at the right position before it is delivered.

Since the hole cutting position of the punching process is defined by a predetermined distance L1 (e.g., 12 mm) from the tail end p0 of the sheet of paper P as viewed in the direction of conveying the sheet of paper P, it is important to define the gap L2 between the third conveyer roller pair 53 and the hole cutting blade 41 to be equal to the difference of the length L0 of the sheet of paper P as viewed in the direction of conveying the sheet of paper P and the distance L1 (L2=L0−L1).

As described above, with a sheet processing apparatus 30 according to the present invention, a sheet of paper P is conveyed from the upstream to the downstream and, upon detecting a suitable condition of conveying the sheet of paper P, the third conveyer roller pair 53 is stopped to allow the leading end of the sheet of paper P to abut the third conveyer roller pair 53 and correct the skew, if any. In other words, the skew, if any, of the sheet of paper P is corrected at the downstream side as viewed in the direction of conveying the sheet of paper P and the punching process is conducted at the upstream side so that it is always possible to cut a hole at the right position. Additionally, the mechanism of the apparatus can be designed without difficulty because all the conveyer roller pairs including the first, second and third conveyer roller pairs 51, 52 53 can be arranged in the finisher 20.

Figure 6:
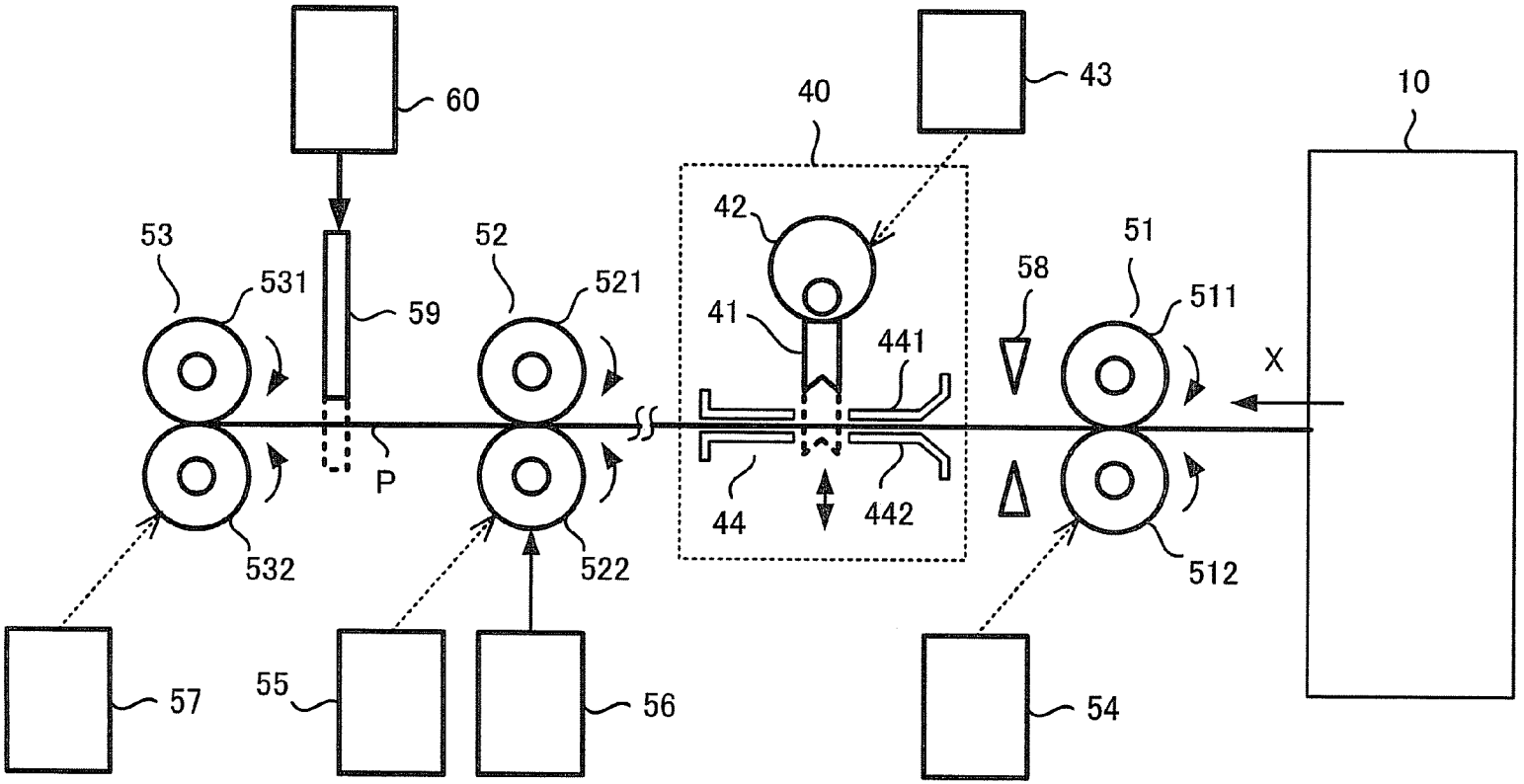
FIG. 6 is a schematic illustration of another embodiment of sheet processing apparatus according to the present invention, showing the configuration thereof.

FIG. 6 is a schematic illustration of another embodiment of sheet processing apparatus 30 according to the present invention, showing the configuration thereof. Referring to FIG. 6, a shutter 59 is arranged between the second conveyer roller pair 52 and the third conveyer roller pair 53 so as to be driven to move up and down by a motor 60. If the shutter 59 is at the upside of the route of conveying a sheet of paper P, it can be driven to project downward across the route of conveying the sheet of paper P by the motor 60.

In other words, the shutter 59 operates as a stopper for the sheet of paper P that appears at a position downstream relative to the second conveyer roller pair 52 to block the sheet of paper P that is being conveyed and moving forward after passing the second conveyer roller pair 52. It is important to define the gap between the shutter 59 and the hole cutting blade 41 of the punching unit 40 to be equal to L0−L1, where L1 is the distance between the hole cutting position and the tail end p0 of the sheet of paper P as shown in FIG. 5 and L0 is the length of the sheet of paper P.

Thus, while the leading end of the sheet of paper P is made to abut the third conveyer roller pair 53 in the embodiment of FIG. 2, the shutter 59 is made to project across the route of conveying the sheet of paper P and the sheet of paper P is made to abut the shutter 59 in the embodiment of FIG. 6 in order to correct the skew, if any. The timing of projecting the shutter 59 across the route of conveying the sheet of paper P is made to agree with the time when the sensor 58 detects the leading end of the sheet of paper P passing the first conveyer roller pair 51 (immediately after the situation of FIG. 4A), whereas the timing of retracting the shutter 59 is made to agree with the time when the punching process comes to end (immediately before the situation of FIG. 4E).

For the purpose of controlling the forward and backward movements of the shutter 59 with regard to the route of conveying the sheet of paper P, a motor drive circuit 67 for driving the motor 60 is provided and controlled by control section 61 and the operation of the shutter 59 is controlled in response to the outcome of detection of the sensor 58 as shown by dotted line in FIG. 3. Thus, as a result of providing a shutter 59, the sheet of paper P reliably abuts it when it is driven to move backward so that it is possible to highly reliably correct the skew.

The position where the shutter 59 is made to project is adjustable and the gap between hole cutting blade 41 of the punching unit and the stopper 59 can be changed according to the size of the sheet of paper being conveyed. In other words, the position where the shutter 59 is made to project is controlled by the control section 61 according to the information on the size of the sheet of paper.

For example, when a size of sheet of paper is selected by way of the operation section 13, the position where the shutter 59 is made to project is controlled and changed, if necessary, according to the information on the selected size of sheet of paper. Alternatively, it may be so arranged that a size sensor for detecting the size of the selected sheet of paper and the position where the shutter 59 is made to project is controlled and changed, if necessary, according to the information on the detected size of sheet of paper.

Figure 7:
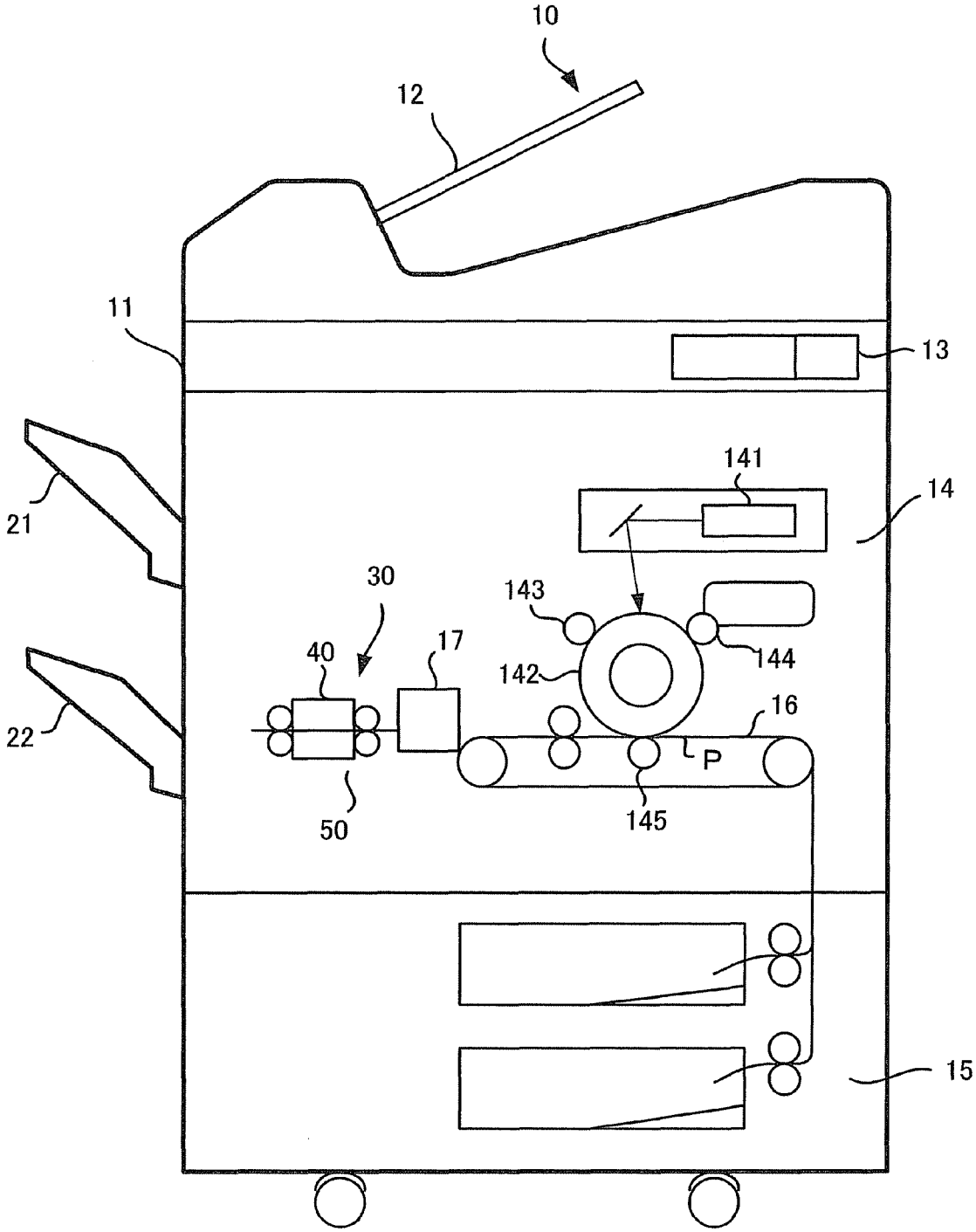
FIG. 7 is a schematic illustration of another image forming apparatus equipped with a sheet processing apparatus according to the present invention, showing the overall configuration thereof.

In the instance of FIG. 1, a finisher 20 is arranged contiguously relative to the image forming apparatus 10 and provided with a punching unit 40. However, the punching unit 40 may alternatively be contained in the image forming apparatus 10. More specifically, as shown in FIG. 7, the printer section 14 and the sheet processing apparatus 30 may be arranged in a main body of the image forming apparatus 10 and the sheet of paper P delivered from the printer section 14 may be subjected to a hole cutting process by the punching unit 40 and then to a skew correcting process.

Thus, with a sheet processing apparatus according to the invention as described above, the sheet of paper being conveyed from the upstream side to the downstream side is made to abut the stopper in order to correct the skew, if any, thereof before it is subjected to a punching process after the skew correction. Therefore, a sheet processing apparatus according to the present invention can always punch a sheet of paper at the right position.

Although exemplary embodiments of the present invention have been shown and described, it will be apparent to those having ordinary skill in the art that a number of changes, modifications or alternations to the invention as described herein may be made, none of which depart from the spirit of the present invention. All such changes, modifications and alterations should therefore be seen as within the scope of the present invention.

What is claimed is:

1. A sheet processing apparatus for executing a hole cutting process on a sheet of paper carrying an image formed thereon, the apparatus comprising:

a sheet conveying section including a first conveyer roller pair, a second conveyer roller pair, and a third conveyer roller pair arranged sequentially from the upstream side to the downstream side on a sheet conveyance route and adapted to convey a sheet of paper in a first direction directed from the upstream side to the downstream side, the second and third conveyer roller pairs are adapted to pinch the sheet of paper between the rollers thereof;

a punching unit arranged between the first conveyer roller pair and the second conveyer roller pair and adapted to execute a hole cutting process on the sheet of paper;

a skew correcting section adapted to stop rotary motion of the third conveyer roller pair before the leading end of the sheet of paper being conveyed on the conveyance route gets to the third conveyer roller pair, and operate the second conveyor roller pair as a slipping roller so as to make the leading end of the sheet of paper being conveyed in the first direction abut, without constraining by, the third conveyer roller pair, the second conveyor roller pair is in contact with each other and rotate in order to correct the skew of the sheet of paper; and a control section to change the position of the third conveyer roller pair according to the size of the sheet of paper, and the hole cutting position for the sheet of paper being defined by the gap between the punching unit and the third conveyer roller pair so as to execute a hole cutting on the sheet of paper corrected for the skew at a position near the tail end thereof.

2. The apparatus according to claim 1, wherein, the length of the sheet of paper is L0 as viewed in the direction of being conveyed and the gap between the tail end of the sheet of paper and the hole cutting position is L1, while the gap between the hole cutting position of the punching unit and the third conveyer roller pair is L2, L2 is defined by L2=L0-L1.

3. The apparatus according to claim 1, wherein after the time when the tail end of the sheet of paper passes the first conveyer roller pair, the skew correcting section is adapted to make the leading end of the sheet of paper abut the third conveyer roller pair in order to correct the skew, in a condition where the rollers of the second conveyer roller pair are made to lightly contact with each other.

4. The apparatus according to claim 1, wherein the control section is adapted to detect the position of the sheet of paper on the conveyance route and control the rotating conditions of the first, second, and third conveyer roller pairs, the position of the third conveyer roller pair and the punching process of the punching unit.

5. The apparatus according to claim 4, wherein a sensor is arranged at a position close to the first conveyer roller pair in order to detect the position of the sheet of paper on the conveyance route.

6. The apparatus according to claim 1, wherein the stopper of the skew correcting section is formed by a shutter arranged at a position downstream relative to the second conveyer roller pair by the sheet conveyance route and adapted to project across the sheet conveyance route so as to make the leading end of the sheet of paper being conveyed to abut the projected shutter in order to correct the skew, if any, thereof.

7. The apparatus according to claim 6, wherein the shutter is adapted to retractably project across the sheet conveyance route by means of a drive motor.

8. A sheet processing apparatus for executing a hole cutting process on a sheet of paper carrying an image formed thereon, the apparatus comprising:

a sheet conveying section including a first conveyer roller pair, a second conveyer roller pair, and a third conveyer roller pair arranged sequentially from the upstream side to the downstream side on a sheet conveyance route and adapted to convey a sheet of paper in a first direction directed from the upstream side to the downstream side, the second and third conveyer roller pairs are adapted to pinch the sheet of paper between the rollers thereof;

a punching unit arranged between the first conveyer roller pair and the second conveyer roller pair and adapted to execute a hole cutting process on the sheet of paper;

a skew correcting section adapted to stop rotary motion of the third conveyer roller pair before the leading end of the sheet of paper being conveyed on the conveyance route gets to the third conveyer roller pair, and operate the second conveyer roller pair as a slipping roller so as to make the leading end of the sheet of paper being conveyed in the first direction abut, without constraining by, the third conveyer roller pair in order to correct the skew of the sheet of paper; and a control section to change the position of the third conveyer roller pair according to the size of the sheet of paper, and the hole cutting position for the sheet of paper being defined by the gap between the punching unit and the third conveyer roller pair so as to execute a hole cutting on the sheet of paper being corrected for the skew at a position near the tail end thereof, and control the first and second conveyer roller pairs being driven to rotate after executing a hole cutting so as to deliver the sheet of paper.

9. The apparatus according to claim 8, wherein when the second conveyor roller pair operates as a slipping roller, the rollers thereof are made to lightly contact with each other.

10. The apparatus according to claim 8, wherein the skew correcting section suspends the conveying force of the conveyer roller pair located upstream relative to the second conveyer roller pair while the second conveyer roller pair is operating as a slipping roller.

11. The apparatus according to claim 8, wherein the stopper of the skew correcting section is formed by a shutter arranged at a position downstream relative to the second conveyer roller pair by the sheet conveyance route and adapted to project across the sheet conveyance route so as to make the leading end of the sheet of paper being conveyed to abut the projected shutter in order to correct the skew, if any, thereof.

* * * * *